United States Patent [19]

Kacher

[11] Patent Number: 4,749,509

[45] Date of Patent: Jun. 7, 1988

[54] AQUEOUS DETERGENT COMPOSITIONS CONTAINING DIETHYLENEGLYCOL MONOHEXYL ETHER SOLVENT

[75] Inventor: Mark L. Kacher, Cincinnati, Ohio

[73] Assignee: The Proctor & Gamble Company, Cincinnati, Ohio

[21] Appl. No.: 933,823

[22] Filed: Nov. 24, 1986

[51] Int. Cl.[4] ..... C11D 3/065

[52] U.S. Cl. ..... 252/139; 252/153; 252/162; 252/170; 252/171; 252/546; 252/558; 252/DIG. 14

[58] Field of Search ..... 252/170, 162, 171, 558, 252/DIG. 14, 139, 153, 546

[56] References Cited

U.S. PATENT DOCUMENTS

| | | | |
|---|---|---|---|
| 3,151,084 | 9/1964 | Schütz | 252/137 |
| 3,308,068 | 3/1967 | Jones | 252/554 |
| 3,887,497 | 6/1975 | Ulvild | 252/526 |
| 3,966,627 | 6/1976 | Gray | 252/99 |
| 4,576,738 | 3/1986 | Colodney | 252/559 |

*Primary Examiner*—Paul Lieberman
*Assistant Examiner*—Isabelle Rodriquez
*Attorney, Agent, or Firm*—Robert B. Aylor; Ronald L. Hemingway; Richard C. Witte

[57] ABSTRACT

Aqueous detergent compositions comprising an organic synthetic detergent, a water-soluble detergency builder and diethyleneglycol monohexyl ether solvent.

9 Claims, No Drawings

AQUEOUS DETERGENT COMPOSITIONS CONTAINING DIETHYLENEGLYCOL MONOHEXYL ETHER SOLVENT

FIELD OF THE INVENTION

This invention pertains to aqueous detergent compositions which contain organic solvents to improve cleaning performance.

BACKGROUND OF THE INVENTION

Aqueous detergent compositions for cleaning hard surfaces such as floors, walls, bathroom tile, etc., typically contain a surfactant and a water-soluble sequestering builder.

The inclusion of water-soluble or dispersible organic solvents in such compositions to improve their cleaning performance has been described in numerous patents. Examples are: tertiary alcohols—U.S. Pat. No. 4,287,080, Siklosi, issued Sept. 1, 1981; benzyl alcohol and terpenes—U.S. Pat. No. 4,414,128, Goffinet, issued Nov. 8, 1983; glycol ethers—U.S. Pat. No. 3,882,038, Clayton et al., issued May 6, 1975; glycols—U.S. Pat. No. 3,463,735, Stonebraker et al., issued Aug. 26, 1969; $C_6$–$C_{16}$ diols—U.S. Ser. No. 811,268, Siklosi, filed Dec. 20, 1985. These various solvents differ from each other in the degree to which they enhance cleaning performance, the ease with which they can be formulated into aqueous built detergent systems (i.e., need for hydrotropes and/or co-solvents), biological safety, and type and intensity of odor.

The object of the present invention is to provide aqueous, organic solvent-containing, built, hard surface cleaning compositions utilizing a solvent which has low odor and high cleaning efficiency, and which can be easily formulated into the composition.

SUMMARY OF THE INVENTION

The present invention is directed to aqueous, built, hard surface cleaning compositions which contain diethyleneglycol monohexyl ether as a solvent to enhance cleaning performance.

DETAILED DESCRIPTION OF THE INVENTION

In accordance with the present invention, it has been found that diethyleneglycol monohexyl ether (DGMHE) is an especially useful solvent for incorporation into aqueous built liquid cleaner compositions to improve the cleaning effectiveness of said compositions. It provides an improved cleaning benefit for such compositions which is superior to that provided by diethyleneglycol monobutyl ether (Butyl Carbitol) and is at least equal to that provided by 2,2,4-trimethyl-1,3-pentanediol (TMPD), a previously known highly effective solvent for improving the cleaning performance of aqueous built liquid cleaners. It is easier to formulate into aqueous built products than TMPD, however, in that it is a liquid rather than a solid at room temperature and, depending on the specific product composition, DGMHE will generally require either no hydrotroping agent or less hydrotroping agent then required by TMPD for maintenance of a single phase homogeneous product. Unlike Butyl Carbitol and TMPD, DGMHE is substantially odorless, which is also an advantageous property in the formulation of consumer products.

The aqueous liquid compositions of the present invention comprise:

(a) from about 0% to about 15% of a synthetic organic surfactant;

(b) from about 0.5% to about 70% of a water-soluble detergency builder;

(c) from about 0.5% to about 15% of diethyleneglycol monohexyl ether; and (d) water.

All percentages and ratios herein are "by weight" unless otherwise specified.

The Surfactant

Compositions of this invention typically contain organic synthetic surface-active agents ("surfactants") to provide the usual cleaning and emulsifying benefits associated with the use of such materials. In certain specialized products such as spray window cleaners, however, surfactants are sometimes not used since they may produce a filmy/streaky residue on the glass surface.

Surfactants useful herein include well-known synthetic anionic, nonionic, amphoteric and zwitterionic surfactants. Typical of these are the alkyl benzene sulfonates, alkyl- and alkylether sulfates, paraffin sulfonates, olefin sulfonates, alkyl di- and polysulfonates, alkoxylated (especially ethoxylated) alcohols and alkyl phenols, amine oxides, alpha-sulfonates of fatty acids and of fatty acid esters, alkyl betaines, and the like, which are well-known from the detergency art. In general, such detersive surfactants contain an alkyl group in the $C_9$–$C_{18}$ range. The anionic detersive surfactants can be used, for example, in the form of their sodium, potassium, ammonium or triethanolammonium salts. The nonionic surfactants generally contain from about 5 to about 17 ethylene oxide groups. $C_{11}$–$C_{16}$ alkyl benzene sulfonates, $C_{12}$–$C_{18}$ paraffin-sulfonates, alkyl sulfates, alkyl ether sulfates containing from 1 to 3 ethoxy ether groups, and amine oxides are especially preferred in the compositions of the present type.

The surfactant component, when present, may comprise as little as 0.1% of the compositions herein, but typically the compositions will contain from about 0.25% to about 10%, more preferably from about 1% to about 5% of surfactant.

A detailed listing of suitable surfactants for the detergent compositions herein can be found in U.S. Pat. No. 4,557,853, Collins, issued Dec. 10, 1985, incorporated by reference herein. Commercial sources of such surfactants can be found in McCutcheon's EMULSIFIERS AND DETERGENTS, North American Edition, 1984, McCutcheon Division, MC Publishing Company, also incorporated herein be reference.

Detergency Builder

The detergency builders for use in the compositions of the invention can be any of the water-soluble calcium and/or magnesium ion-sequestering materials which are useful in the detergency art. Examples of such compounds include nitrilotriacetates (e.g., sodium nitrilotriacetate), polycarboxylates (e.g., sodium mellitate), citrates (e.g., sodium citrate), water-soluble phosphates such as sodium tripolyphosphate and sodium and potassium ortho- and pyrophosphates, polyaminocarboxylates (e.g., disodium ethylenediaminetetraacetate, tetrasodium diethylenetriamine pentaacetate), the aminopolyphosphonates (e.g., disodium diethylenetriamine tetra(methylenephosphonic acid) and disodium nitrilo tri(methylenephosphonic acid), and a wide variety of other poly-functional organic acids and salts too numerous to mention in detail here. See U.S. Pat. No. 3,579,454, Collier, issued May 18, 1971 (incorporated by reference herein), for typical examples of the use of such materials in various cleaning compositions. Particularly preferred detergency builders for use in the compositions herein are hydroxyalkyl amine diacetic acids (and salts) of the formula:

$$H(OC_2H_4)_n N(CH_2COOM)_2$$

wherein n is 1 or 2 and M is alkali metal (e.g., Na or K), ammonium or hydrogen. The most preferred compound is N-diethylene glycol-N,N-iminodiacetic acid (DIDA) and its salts (i.e., the compound of the above formula wherein n is 2.

These are known compounds and can be prepared by reacting one mole of the appropriate alkoxylated primary amine with two moles of sodium chloroacetate in aqueous solution containing two mole equivalents of base to neutralize the hydrochloric acid formed in the reaction.

Another method of preparation is to react one or two moles of ethylene oxide with one mole of iminodiacetic acid in ethanol at 100°–180° C. and 10–100 atmospheres pressure in the presence of an alkali metal hydroxide catalyst (See Japanese Patent Application Sho. 59-70652, published Apr. 21, 1984, incorporated by reference herein.

The amount of detergency builder in the compositions herein is from about 0.5% to about 70%, preferably from about 0.5% to about 15%, and most preferably from about 2% to about 8%.

Solvent

The required solvent for the compositions of the present invention is diethyleneglycol monohexyl ether (DGMHE), This material can be made by reaction of 1-hexanol with ethylene oxide. It is commercially available as Hexyl Carbitol ® from Union Carbide Corporation.

DGMHE is used in the compositions of the invention at levels of from about 0.5% to about 15%, preferably from about 3% to about 11%.

Optional Ingredients

The compositions herein can optionally contain the usual auxilliary ingredients found in liquid hard surface cleaners, such as dyes, perfumes, ammonia and suds suppressing agents such as coconut fatty acids. Although hydrotropes (e.g., sodium or potassium toluene, xylene or cumene sulfonates) are generally not needed in the present compositions, they may, depending upon the surfactant system used, be needed in certain formulations particularly to maintain phase stability in low temperature storage conditions.

Preferably the pH should be in the range of about 8 to 12. Conventional pH adjustment agents such as sodium hydroxide, sodium carbonate or hydrochloric acid can be used if adjustment is necessary.

Other solvents can be included in the compositions herein as cosolvents with DGMHE. These include glycol ethers such as diethyleneglycol monobutyl ether, ethyleneglycol monobutyl ether, ethyleneglycol monohexyl ether, propyleneglycol monbutyl ether, dipropyleneglycol monobutyl ether, and diols such as 2,2,4-trimethyl-1,3-pentanediol and 2-ethyl-1,3-hexanediol. Preferred cosolvents are 2,2,4-trimethyl-1,3-pentanediol, propyleneglycol monobutyl ether and dipropyleneglycol monobutyl ether. When cosolvents are used they will usually be combined with DGMHE in ratios between about 10:1 to about 1:10, with the total amount of DGMHE and cosolvent in the composition being within the range of from 0.5% to 15%.

Additionally, highly volatile solvents such as isopropanol or ethanol can be used in the present compositions to facilitate faster evaporation of the composition from surfaces when the surface is not rinsed after "full strength" application of the composition to the surface. When used, volatile solvents are typically present at levels of from about 2% to about 12% in the compositions.

The invention will be illustrated by the following examples.

EXAMPLE 1

Typical Synthesis of Sodium Diethyleneglycoliminodiacetic Acid ($Na_2$ Salt)

N-diethyleneglycol-N,N-iminodiacetic acid, used as a builder in several of the succeeding examples, can be prepared in the following manner.

237.7 gms (2.04 moles) of sodium chloroacetate is added to 100 ml of distilled water. To this mixture, 105.0 gms (1.0 moles) of 2-(2-aminoethoxy)ethanol dissolved in 100 ml distilled water is added slowly (5–10 minutes), with stirring. The vessel containing the mixture is then immersed in a water/ice bath and 81.6 gms (2.04 moles) of sodium hydroxide dissolved in 250 gms distilled water is slowly added with stirring, keeping the temperature at 25±1° C. The addition takes approximately 2 hours. The reaction continues to be stirred at room temperature overnight (16 hours). An aliquot is titrated with copper sulfate/murexide indicator (see titration procedure below) to check for completeness of reaction. An equal volume of methanol is added to the reaction mixture, the mixture is cooled and the precipitated sodium chloride is filtered. The mixture is concentrated by means of a rotary evaporator to a thick slurry. The methanol treatment is repeated twice more to eliminate the sodium chloride. The final product is typically a 40–45% aqueous solution of DIDA ($Na_2$ salt) and the overall yield is 80–85%. If desired, the DIDA ($Na_2$ salt) can be obtained in dry form by evaporation of the water.

The following titration method is used to determine % DIDA in solution:

Approximately 0.25 gm of sample is weighed accurately and dissolved in 75 ml of distilled water. Three drops of phenolthalein indicator are added and the sample is titrated with 0.5N HCl to an endpoint (slightly pink). 10 mls of pH buffer and 1.0 gm of murexide indicator are added and the solution is titrated with 0.025M copper sulfate solution to an endpoint. (Color at the endpoint goes from pink to purple to gray to green and gray is the endpoint). The calculation for % DIDA (Na salt) is:

$$\% \text{ DIDA } (Na_2 \text{ Salt}) = \frac{\text{mls } CuSO_4 \times \text{Normality } CuSO_4 \times \text{MW } Na_2 \text{ DIDA}/10}{\text{wt. of sample}}$$

EXAMPLES 2–7

The following clear liquid cleaning formulas were made and tested for soil removal:

| Component | Formula No. 2 | 3 | 4 | 5 | 6 | 7 |
|---|---|---|---|---|---|---|
| $Na_2$ DIDA[1] | 2.9% | 2.9% | — | — | — | — |
| EDTA[2] | — | — | 2.9% | 2.9% | — | — |
| Na Citrate | — | — | — | — | 2.9% | 2.9% |
| $NaC_{11.3}$ Alkylbenzene sulfonate | 1.95 | — | 1.95 | — | 1.95 | — |
| $NaC_{12}$ Alkylsulfate | — | 2.2 | — | 2.2 | — | 2.2 |
| $NaC_{12}$(ethoxy)$_3$ sulfate | — | 2.2 | — | 2.2 | — | 2.2 |
| $C_{12}$ Dimethylamine oxide | — | 0.5 | — | 0.5 | — | 0.5 |
| Na Cumene sulfonate | 1.3 | — | 1.3 | — | 1.3 | — |
| Hexyl Carbitol[3] | 6.3 | 6.3 | 6.3 | 6.3 | 6.3 | 6.3 |
| Water[4] | Balance to 100% | | | | | |

[1]Disodium N—diethyleneglycol-N,N—iminodiacetate
[2]$Na_4$ ethylenediamine diacetic acid
[3]Diethyleneglycol monohexyl ether
[4]All formulas adjusted to pH 10.5

All of the above formulas are clear, homogeneous, substantially odorless liquids, and have excellent cleaning performance on hard surfaces such as walls, floors, bathtubs and sinks.

What is claimed is:

1. An aqueous liquid cleaning composition consisting essentially of:

(a) from about 0% to about 15% of a synthetic organic surfactant;

(b) from about 0.5% to about 70% of a water-soluble detergency builder;

(c) from about 0.5% to about 15% of diethyleneglycol monohexyl ether; and (d) the balance being water.

2. The composition of claim 1 wherein the level of water-soluble detergency builder is from about 0.5% to about 15%.

3. The composition of claim 2 wherein the level of surfactant is from about 0.25% to about 10%.

4. The composition of claim 3 wherein the amount of detergency builder is from about 2% to about 8% and the amount of diethyleneglycol monohexyl ether is from about 3% to about 11%.

5. The composition of claim 4 wherein the surfactant is selected from the group consisting of alkylbenzene sulfonates having 11 to 16 carbons in the alkyl chain, $C_{12}$–$C_{18}$ paraffin sulfonates, $C_{12}$–$C_{18}$ alkyl sulfates, $C_{12}$–$C_{18}$ alkyl ether sulfates containing from 1 to 3 ethoxy ether groups, $C_{12}$–$C_{18}$ amine oxides, and mixtures thereof.

6. The composition of claim 5 wherein the builder is of the formula:

$$H(OC_2H_4)_n\ N(CH_2COOM)_2$$

wherein n is 1 or 2 and M is alkali metal, ammonium or hydrogen.

7. The composition of claim 6 wherein n is 2.

8. The composition of claim 2 wherein the builder is of the formula:

$$H(OC_2H_4)_n\ N(CH_2COOM)_2$$

wherein n is 1 or 2 and M is alkali metal, ammonium or hydrogen.

9. The composition of claim 8 wherein n is 2.

* * * * *